US008979432B2

(12) United States Patent
Uemura et al.

(10) Patent No.: US 8,979,432 B2
(45) Date of Patent: Mar. 17, 2015

(54) VORTEX FLOW TYPE WATER SURFACE CONTROL DEVICE FOR DRAINING DEVICE

(75) Inventors: Ikuo Uemura, Saitama (JP); Hirofumi Ishiwada, Tokyo (JP); Shouichi Banba, Tokyo (JP); Aya Uchino, Tokyo (JP); Tsuneo Ochiai, Tokyo (JP); Hiroshi Komatsu, Chiba (JP); Shigeki Nishimura, Saitama (JP); Shigeru Tukada, Saitama (JP)

(73) Assignees: Tokyo Metropolitan Government, Tokyo (JP); Tokyo metropolitan Sewerage Service Corporation, Tokyo (JP); Nippon Koei Co., Ltd., Tokyo (JP)

( * ) Notice: Subject to any disclaimer, the term of this patent is extended or adjusted under 35 U.S.C. 154(b) by 206 days.

(21) Appl. No.: 11/570,813

(22) PCT Filed: Aug. 2, 2004

(86) PCT No.: PCT/JP2004/011394

§ 371 (c)(1),
(2), (4) Date: Mar. 19, 2007

(87) PCT Pub. No.: WO2006/013634

PCT Pub. Date: Feb. 9, 2006

(65) Prior Publication Data

US 2008/0023074 A1 Jan. 31, 2008

(51) Int. Cl.
*B01D 21/26* (2006.01)
*E03F 5/12* (2006.01)

(52) U.S. Cl.
CPC ..... *E03F 5/12* (2013.01)
USPC ..... 405/80; 210/170.03; 210/312; 210/787

(58) Field of Classification Search
CPC ..... E03F 5/12; E03F 5/125; B01D 21/26
USPC ..... 405/60, 74, 80, 89, 93, 97, 101, 108; 210/170.03, 312, 433.1, 512.1, 532.1, 210/787
See application file for complete search history.

(56) References Cited

U.S. PATENT DOCUMENTS 3,666,102 A * 5/1972 Blanchard ..... 210/138
4,151,859 A 5/1979 Jakobi (Continued)

FOREIGN PATENT DOCUMENTS

DE 2614731 4/1977
DE 20112168 2/2002

(Continued)

OTHER PUBLICATIONS

E.P.O. Office action, mail date is Sep. 25, 2013.

(Continued)

*Primary Examiner* — Benjamin Fiorello
(74) *Attorney, Agent, or Firm* — Greenblum & Bernstein, P.L.C.

(57) ABSTRACT

In a conventional storm overflow chamber of a combined sewer system, inflowing floating debris do not flow into an intercepting pipe in a rainy weather, and flow out to a public water body, causing a water pollution in the public water body. According to a vortex flow type water surface control device for a draining device of the present invention, a control plate (6) higher than at least a separating weir (1) is provided between an opening of an inflow pipe (2) and an opening of an intercepting pipe (3) in a storm overflow chamber of a combined sewer system. Moreover, a guide wall (7) higher than at least the separating weir (1) is provided along the separating weir between the opening of the inflow pipe (2) and the separating weir (1).

6 Claims, 7 Drawing Sheets

(56) References Cited

U.S. PATENT DOCUMENTS

| | | | | |
|---|---|---|---|---|
| 5,052,442 | A * | 10/1991 | Johannessen | 137/813 |
| 6,641,720 | B1 | 11/2003 | Crompton et al. | |
| 7,094,337 | B2 * | 8/2006 | Williams et al. | 210/162 |
| 7,138,048 | B1 * | 11/2006 | O'Connor et al. | 210/136 |
| 2004/0222159 | A1 * | 11/2004 | Peters et al. | 210/688 |
| 2005/0045541 | A1 | 3/2005 | Williams et al. | |
| 2005/0077248 | A1 * | 4/2005 | Stark et al. | 210/747 |

FOREIGN PATENT DOCUMENTS

| | | |
|---|---|---|
| GB | 2365448 | 2/2002 |
| GB | 2380691 | 4/2003 |
| JP | 9-209434 | 8/1997 |
| JP | 2002-166105 | 6/2002 |
| JP | 2004-027701 | 1/2004 |
| JP | 2004-238833 | 8/2004 |
| WO | 94/17896 | 8/1994 |

OTHER PUBLICATIONS

English Language Abstract of JP 2004-027701, Jan. 29, 2004.

English Language Abstract of JP 9-209434, Aug. 12, 1997.

English Language Abstract of JP 2004-238833, Aug. 26, 2004.

* cited by examiner

VORTEX FLOW TYPE WATER SURFACE CONTROL DEVICE FOR DRAINING DEVICE

TECHNICAL FIELD

The present invention relates to a vortex flow type water surface control device for a draining device, and more particularly relates to a control device which controls a water surface inside a storm overflow chamber (water separating manhole) which separates rain water and waste water from each other in a draining device used to combine the waste water and the rain water for drainage treatment.

BACKGROUND ART

FIG. 5A and FIG. 5B are respectively plan views of a storm overflow chamber of a conventional combined sewer system, FIG. 6A and FIG. 6B show a state in a fine weather of the storm overflow chamber of the combined sewer system in FIG. 5A. Reference numeral 2 denotes an inflow pipe which opens on a side wall forming the storm overflow chamber. Reference numeral 3 denotes an intercepting pipe which similarly opens on a side wall.

Reference numeral 4 denotes an outflow pipe. Reference numeral 1 denotes a separating weir which is provided in the storm overflow chamber, separates the opening of the inflow pipe 2 and the opening of the intercepting pipe 3 from an opening of the outflow pipe 4, and is higher than the opening of the outflow pipe 4.

Reference numeral 5 denotes floating debris which flow from the inflow pipe 2. FIG. 7A, FIG. 7B, FIG. 8A, and FIG. 8B show states in a rainy weather of the storm overflow chamber of the combined sewer system shown in FIG. 5A.

In the conventional storm overflow chamber shown in FIG. 5A, entire waste water containing the debris 5 flows from the inflow pipe 2 into the intercepting pipe 3 in a fine weather, and then flows into a sewage treatment plant, and a pump station as shown in FIG. 6A and FIG. 6B. Rain water flows into the storm overflow chamber along with waste water in a rainy weather as shown in FIG. 7A and FIG. 7B, and if a water quantity exceeds a certain quantity, the water overflows over the separating weir 1 interposed between the inflow pipe 2 and the outflow pipe 4, and a part of the waste water containing the debris flows out to a public water body via the outflow pipe 4 as shown in FIG. 8A and FIG. 8B.

As described above, in the conventional storm overflow chamber, the inflowing floating debris 5 do not flow into the intercepting pipe 3 in a rainy weather, and flow out to the public water body via the outflow pipe 4, constituting a cause of water pollution in the public water body. One reason is a hydraulic characteristic in the rainy weather in the conventional storm overflow chamber. In the conventional storm overflow chamber, a water surface gradient is formed from the inflow pipe 2 toward the intercepting pipe 3 in a fine weather as shown in FIG. 6A and FIG. 6B, the floating debris 5 thus are entirely brought by the flow into the intercepting pipe 3. However, in a rainy weather, the intercepting pipe 3 is submerged in the water, the water surface rises in a vicinity of the inlet of the intercepting pipe 3, and the water surface gradient from the inflow pipe 2 toward the outflow pipe 3 is not formed as in the fine weather as shown in FIG. 7A and FIG. 7B in a rainy weather. In this state, the floating debris 5 do not flow into the intercepting pipe 3, and remain in the storm overflow chamber. If the quantity of the water flowing into the storm overflow chamber increases, and the water depth consequently exceeds the height of the separating weir 1 in the storm overflow chamber, the water surface gradient is formed by an overflow over the separating weir 1 from the inflow pipe 2 toward the outflow pipe 4 as shown in FIG. 8A and FIG. 8B. On this occasion, the floating debris 5 are almost entirely brought by the flow out to the public water body via the outflow pipe 4.

As means to solve this problem, it is necessary to generate a flow which facilitates the flow of the floating debris 5 into the intercepting pipe 3 in the storm overflow chamber, and it is thus necessary to improve the conventional storm overflow chamber so as to reduce the floating debris which flow out to the public water body.

SUMMARY OF THE INVENTION

According to the present invention, a vortex flow type water surface control device for a draining device including an inflow pipe, an outflow pipe, an intercepting pipe, and a separating weir that is disposed to block the intercepting pipe and the inflow pipe from the outflow pipe is provided. In non-limiting embodiments, the vortex flow type water surface control device may include a control plate that is disposed between an opening of the inflow pipe and an opening of the intercepting pipe, where the height of the control plate is higher than at least the height of the separating weir, where the control plate is apart from the separating weir, and where the separating weir is not located behind the control plate, but is located at a side of the control plate, when the separating weir is viewed from the opening of the inflow pipe.

According to a non-limiting embodiment, the vortex flow type water surface control device for a draining device may include a guide wall that is disposed along the separating weir between the opening of the inflow pipe and the separating weir, the height of the guide wall being higher than at least the height of the separating weir.

According to another non-limiting embodiment, the vortex flow type water surface control device for a draining device may include a guide wall that is disposed between the opening of the inflow pipe and the separating weir, a bottom end of the guide wall being positioned below a top end of the separating weir, a top end of the guide wall being positioned above a pipe top of the intercepting pipe.

According to yet another non-limiting embodiment, the control plate may be located closer to the opening of the intercepting pipe than the opening of the inflow pipe.

According to a further non-limiting embodiment, a bottom end of the control plate may be higher than a bottom of the opening of the inflow pipe.

BEST MODE FOR CARRYING OUT THE INVENTION

A description will now be given of an embodiment of the present invention with reference to drawings.

Figure 1:
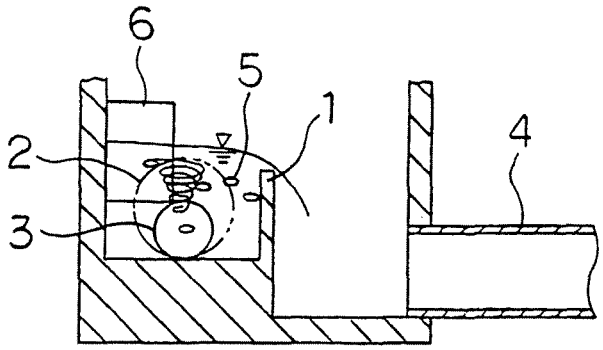
FIG. 1 is a front vertical cross sectional view in a rainy weather of a storm overflow chamber of a combined sewer system using a vortex flow type water surface control device for a draining device according to the present invention.
Figure 2A:
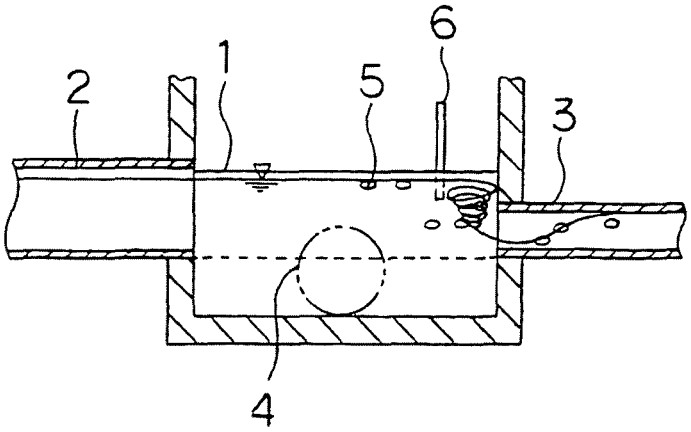
FIG. 2A is a right side vertical cross sectional view in a rainy weather of the storm overflow chamber of the combined sewer system using the vortex flow type water surface control device for a draining device according to the present invention.
Figure 2B:
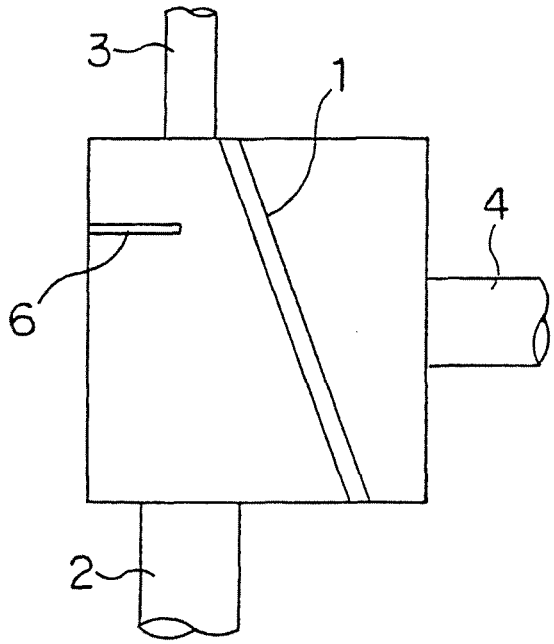
FIG. 2B is a plan view of the device shown in FIG. 1.

According to the present invention, as shown in FIG. 1, FIG. 2A, and FIG. 2B, between an opening of an intercepting pipe 3 and an opening of an inflow pipe 2 is interposed a vertical control plate 6 in a direction to block a passage therebetween. Though a bottom end of the vertical control plate 6 is preferably higher than a top surface of the opening of the intercepting pipe 3 so as not to prevent waste water from flowing down in a fine weather, the bottom end may be lower than the top surface of the opening of the intercepting pipe 3. Though the top end of the vertical control plate 6 is preferably higher than a top surface of a separating weir 1 and a top surface of the opening of the inflow pipe 2, the top end may be lower than the top surface of the opening of the inflow pipe 2.

Since the vortex flow type water surface control device for a draining device according to the present invention has the configuration as described above, a vortex flow is generated on a rear surface (on an intercepting pipe 3 side) of the vertical control plate 6 by a flow which has passed between the vertical control plate 6 and the separating weir 1 from the inflow pipe 2 toward the intercepting pipe 3 in a rainy weather, and floating debris 5 almost entirely flow into the intercepting pipe 3 along the flow as shown in FIG. 1, FIG. 2A, and FIG. 2B.

If the quantity of the water flowing into the storm overflow chamber increases, and the water depth exceeds the height of the separating weir 1 in the storm overflow chamber, the water surface gradient is formed by an overflow over the separating weir 1 from the opening of the inflow pipe 2 toward the opening of the outflow pipe 4 as shown in FIG. 1, FIG. 2A and FIG. 2B.

If the quantity of the water further increases, influence of a surface flow toward the outflow pipe 4 increases, most of the floating debris 5 pass over the separating weir 1, and flow out to the outflow pipe 4, and only a part thereof flows into the intercepting pipe 3, resulting in an insufficient intercepting effect.

Figure 3A:
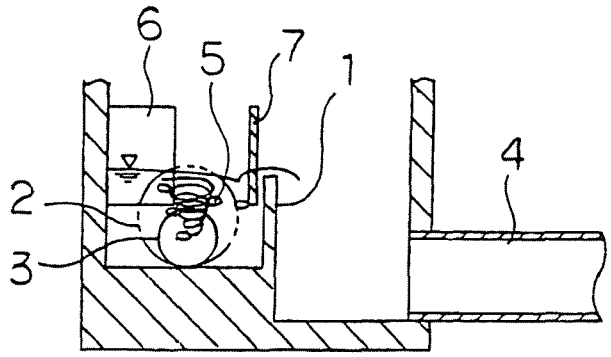
FIG. 3A is a front vertical cross sectional view in a rainy weather of the storm overflow chamber of the combined sewer system using a vortex flow type water surface control device for a draining device according to another embodiment of the present invention.
Figure 3B:
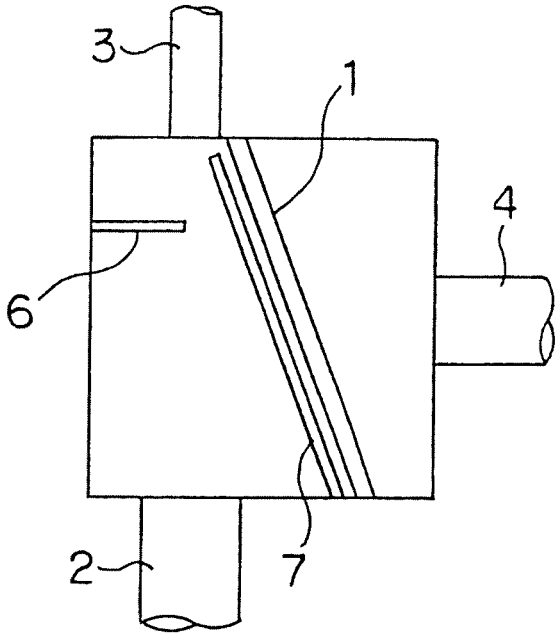
FIG. 3B is a plan view of the device shown in FIG. 3A.
Figure 4:
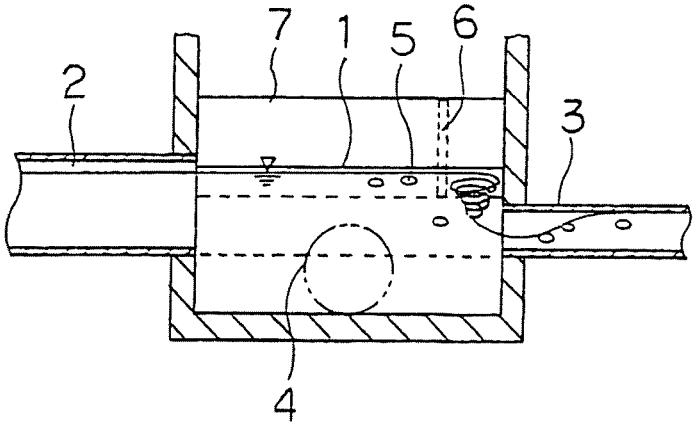
FIG. 4 is a right side vertical cross sectional view in a rainy weather of the storm overflow chamber of the combined sewer system using the vortex flow type water surface control device for a draining device shown in FIG. 3A.

Thus, according to another embodiment of the present invention, a guide wall 7 whose bottom end is slightly lower than the top end of the separating weir 1, and whose top end is higher than the top surface of the opening of the inflow pipe 2 and the top end of the separating weir 1 is provided between the separating weir 1 and the opening of the inflow pipe 2 such that the side surface of the guide wall 7 is almost parallel with a side surface of the vertical control plate 6, as shown in FIG. 3A, FIG. 3B, and FIG. 4.

According to this embodiment, if the water depth is above the height of the separating weir 1 in the storm overflow chamber in a rainy weather, the water surface rises in a vicinity of the guide wall 7, and the water surface gradient is not formed from the opening of the inflow pipe 2 toward the separating weir 1 as shown in FIG. 3A. Moreover, a vortex flow is formed on the rear surface of the vertical control plate 6 as in the previous embodiment, and most of the floating debris 5 are thus brought into the intercepting pipe 3 by the flow thereof, resulting in a higher intercepting effect.

Figure 5A:
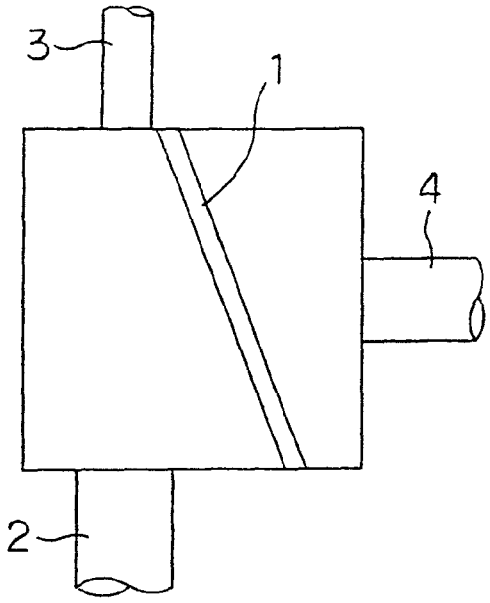
Fig. 5A PRIOR ART
FIG. 5A is a plan view of a conventional storm overflow chamber of a combined sewer system.
Figure 5B:
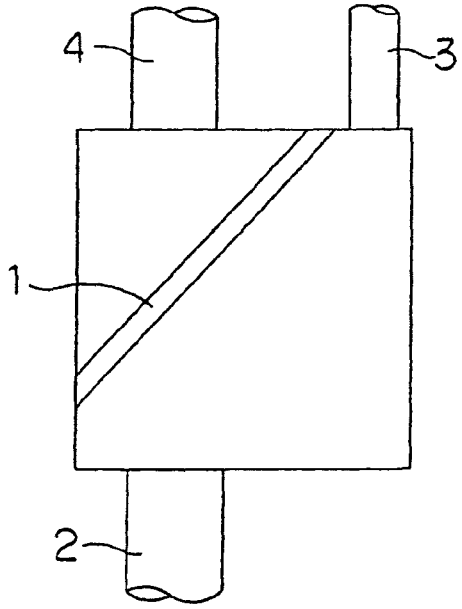
Fig. 5B PRIOR ART
FIG. 5B is a plan view of another conventional storm overflow chamber of a combined sewer system.
Figure 6A:
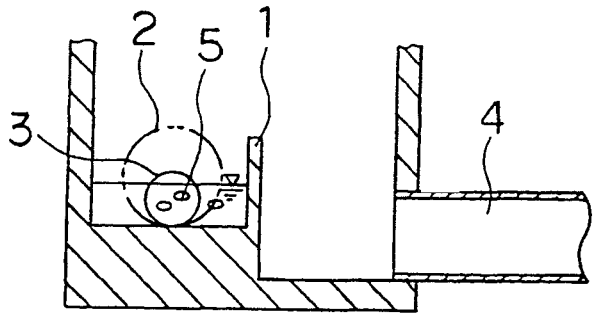
Fig. 6A PRIOR ART
FIG. 6A is a vertical front sectional view in a fine weather of the conventional storm overflow chamber of the combined sewer system shown in FIG. 5A.
Figure 6B:
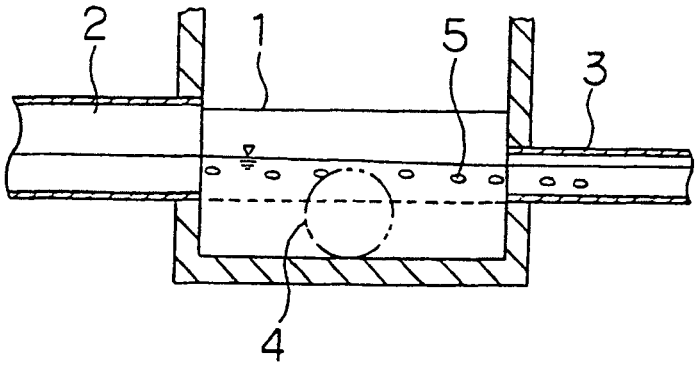
Fig. 6B PRIOR ART
FIG. 6B is a vertical right side sectional view in a fine weather of the conventional storm overflow chamber of the combined sewer system shown in FIG. 5A.
Figure 7A:
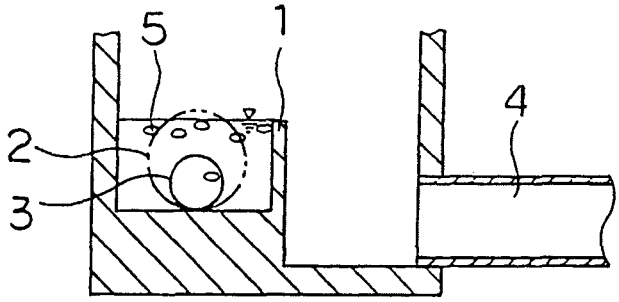
Fig. 7A PRIOR ART
FIG. 7A is a vertical front sectional view in a rainy weather of the conventional storm overflow chamber of the combined sewer system shown in FIG. 5A.
Figure 7B:
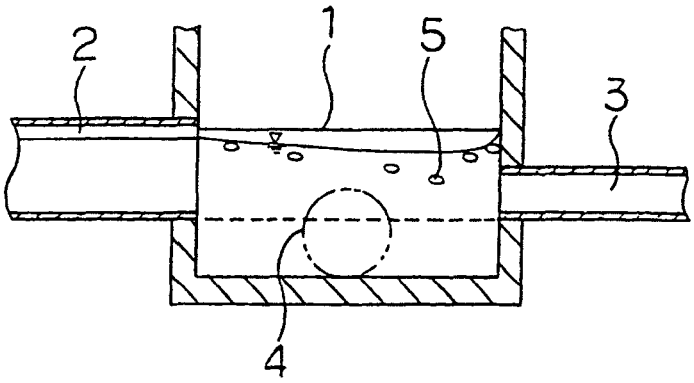
Fig. 7B PRIOR ART
FIG. 7B is a vertical right side sectional view in a rainy weather of the conventional storm overflow chamber of the combined sewer system shown in FIG. 5A.
Figure 8A:
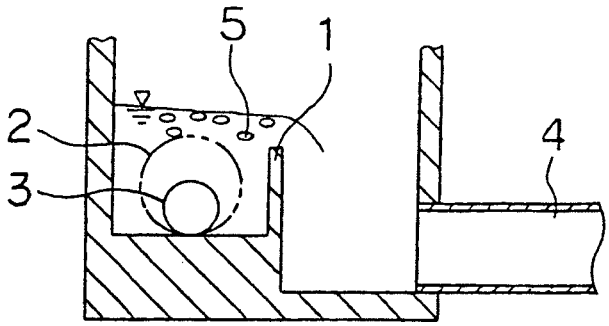
Fig. 8A PRIOR ART
FIG. 8A is a vertical front sectional view in a rainy weather of the conventional storm overflow chamber of the combined sewer system shown in FIG. 5A when a water quantity further increases.
Figure 8B:
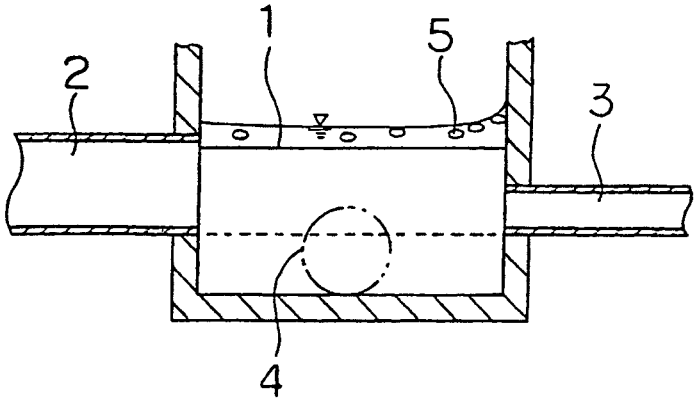
Fig. 8B PRIOR ART
FIG. 8B is a right side front sectional view in a rainy weather of the conventional storm overflow chamber of the combined sewer system shown in FIG. 5A when the water quantity further increases.

It should be noted that the present invention can be similarly applied to a conventional storm overflow chamber (water separating manhole) including an intercepting pipe 3 and an outflow pipe 4 formed on the same wall surface for a combined sewer system as shown in FIG. 5B.

Industrial Applicability

According to the vortex flow type water surface control device for a draining device according to the present invention, there is formed a vortex flow which facilitates the inflow of the floating debris 5 into the intercepting pipe 3, and the floating debris 5 flowing out to a public water body are thus reduced, which is a large benefit.

The invention claimed is:

1. A vortex flow type water surface control device for a draining device that includes an inflow pipe, an outflow pipe, an intercepting pipe, and a separating weir that is disposed to block said intercepting pipe and said inflow pipe from said outflow pipe, comprising a control plate that is disposed between an opening of said inflow pipe and an opening of said intercepting pipe, the height of the control plate being higher than at least the height of said separating weir, wherein said control plate is apart from said separating weir, wherein the separating weir is not located behind said control plate, but is located at a side of said control plate, when said separating weir is viewed from the opening of said inflow pipe, and wherein said control plate is located closer to the opening of the intercepting pipe than the opening of the inflow pipe.

2. The vortex flow type water surface control device for a draining device according to claim 1, further comprising a guide wall that is disposed between the opening of said inflow pipe and said separating weir, the height of the guide wall being higher than at least the height of said separating weir.

3. The vortex flow type water surface control device for a draining device according to claim 1, further comprising a guide wall that is disposed between the opening of said inflow pipe and said separating weir, a bottom end of the guide wall being positioned below a top end of said separating weir, a top end of the guide wall being positioned above a pipe top of said intercepting pipe.

4. A vortex flow type water surface control device for a draining device that includes an inflow pipe, an outflow pipe, an intercepting pipe, and a separating weir that is disposed to block said intercepting pipe and said inflow pipe from said outflow pipe, comprising a control plate that is disposed between an opening of said inflow pipe and an opening of said intercepting pipe, the height of the control plate being her than at least the height of said separating weir, wherein said control plate is apart from said separating weir, wherein the separating weir is not located behind said control plate, but is located at a side of said control plate, when said separating weir is viewed from the opening of said inflow pipe, and wherein a bottom end of said control plate is higher than a bottom of the opening of said inflow pipe.

5. The vortex flow type water surface control device for a draining device according to claim 4, further comprising a guide wall that is disposed between the opening of said inflow pipe and said separating weir, the height of the guide wall being higher than at least the height of said separating weir.

6. The vortex flow type water surface control device for a draining device according to claim 4, further comprising a guide wall that is disposed between the opening of said inflow pipe and said separating weir, a bottom end of the guide wall being positioned below a top end of said separating weir, a top end of the guide wall being positioned above a pipe top of said intercepting pipe.

* * * * *

UNITED STATES PATENT AND TRADEMARK OFFICE

CERTIFICATE OF CORRECTION

PATENT NO. : 8,979,432 B2
APPLICATION NO. : 11/570813
DATED : March 17, 2015
INVENTOR(S) : Uemura et al.

It is certified that error appears in the above-identified patent and that said Letters Patent is hereby corrected as shown below:

In the claims,

At column 5, line 5 (claim 4, line 7) of the printed patent, please change “her” to --higher--.

Signed and Sealed this
Twenty-seventh Day of October, 2015

Michelle K. Lee

Michelle K. Lee
*Director of the United States Patent and Trademark Office*